United States Patent [19]

DeBruyn

[11] Patent Number: 4,587,908

[45] Date of Patent: May 13, 1986

[54] ROTARY SHELF ASSEMBLY WITH BEARING ASSEMBLY AND DETENT MECHANISM

[75] Inventor: William DeBruyn, Rockford, Ill.

[73] Assignee: Amerock Corporation, Rockford, Ill.

[21] Appl. No.: 711,056

[22] Filed: Mar. 12, 1985

[51] Int. Cl.[4] ..... A47B 11/00; A47B 57/00; G05G 5/06; F16M 13/00

[52] U.S. Cl. ..... 108/142; 74/527; 248/418; 312/305; 312/326

[58] Field of Search ..... 312/305, 326, 329, 125, 312/135, 238; 74/527; 312/11, 197; 108/139, 142, 137; 248/417, 418, 425

[56] References Cited

U.S. PATENT DOCUMENTS

| | | | |
|---|---|---|---|
| 953,205 | 3/1910 | Hughes | 312/326 |
| 1,264,473 | 4/1918 | Baker | 74/527 |
| 1,634,922 | 7/1927 | Stubblebine | 248/418 |
| 1,781,015 | 11/1930 | Keipp | 108/142 |
| 1,918,190 | 7/1933 | Miller | 248/217 |
| 2,693,989 | 11/1954 | Santana | 312/305 |
| 3,107,891 | 10/1963 | Burke | 248/417 |
| 3,253,888 | 5/1966 | Degen | 108/142 |
| 3,266,857 | 8/1966 | Anderson | 312/252 |
| 3,281,197 | 10/1966 | Anderson | 312/305 |
| 3,982,800 | 9/1976 | Gordon | 312/305 |
| 4,181,037 | 1/1980 | Boon et al. | 74/312 |
| 4,418,970 | 12/1983 | Hyder | 312/305 |
| 4,433,885 | 2/1984 | Baker | 312/305 |
| 4,440,459 | 4/1984 | Hallgren | 312/305 |

FOREIGN PATENT DOCUMENTS

| | | | |
|---|---|---|---|
| 511034 | 5/1952 | Belgium | 312/305 |

OTHER PUBLICATIONS

Installation Instructions for Lescoa HB0250 Lazy Susan Set, publication date unknown.

Pages 1, 5, 9, 11, 15, 17, 18, 19 and 20 of a catalog published by Scovill, Inc. in 1980 and entitled *Nu-Tone Ajax Rev-A-Shelf Cabinet Storage Organizers.*

*Primary Examiner*—William E. Lyddane
*Assistant Examiner*—Gerald A. Anderson
*Attorney, Agent, or Firm*—Leydig, Voit & Mayer, Ltd.

[57] ABSTRACT

Two vertically spaced shelves with pie-shaped cut outs are rotatably supported on a fixed post in a corner cabinet. Each shelf is rotatably mounted on the post by an anti-friction bearing assembly comprising a rotatable bearing member attached to the shelf and a fixed bearing member attached to the post. To enable the pie-shaped cut out of the shelf to be located in a predetermined angular home position relative to the cabinet door, a detent mechanism is incorporated in the bearing assembly. The detent mechanism includes a cage carried by the rotatable bearing member and supporting a detent ball which snaps into a detent notch in the fixed bearing member to hold the shelf releasably in its home position.

9 Claims, 8 Drawing Figures

ROTARY SHELF ASSEMBLY WITH BEARING ASSEMBLY AND DETENT MECHANISM

BACKGROUND OF THE INVENTION

This invention relates generally to a rotatable shelf assembly preferably adapted to be mounted in a cabinet and including one or more rotatable storage shelves supported by an upright mounting post. The invention more specifically relates to a shelf assembly of the type in which a detent mechanism is adapted to hold each shelf releasably in a predetermined angular position relative to the post so that the shelf may occupy a home position in the cabinet when the cabinet door is closed and then may be rotated from that position when the door is opened.

SUMMARY OF THE INVENTION

The general aim of the present invention is to provide a new and improved shelf assembly of the above general type in which each shelf is supported to rotate about a fixed mounting post by a unique bearing assembly which also incorporates the detent mechanism so that the bearing assembly and the detent mechanism can be attached to the shelf and installed on the post as a simple and compact unit.

A more detailed object is to achieve the foregoing by providing a bearing assembly having fixed and rotatable bearing members and having a detent mechanism adapted to be carried by the rotatable bearing member and adapted to act against the fixed bearing member to hold the shelf releasably in its home position while allowing the shelf to be selectively rotated about the fixed mounting post.

The invention also resides in the unique construction of the bearing assembly and the detent mechanism for orienting the parts thereof properly relative to each other and to the shelf to enable quick and foolproof assembly of the parts and quick and foolproof attachment of the assembly to the shelf.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3:
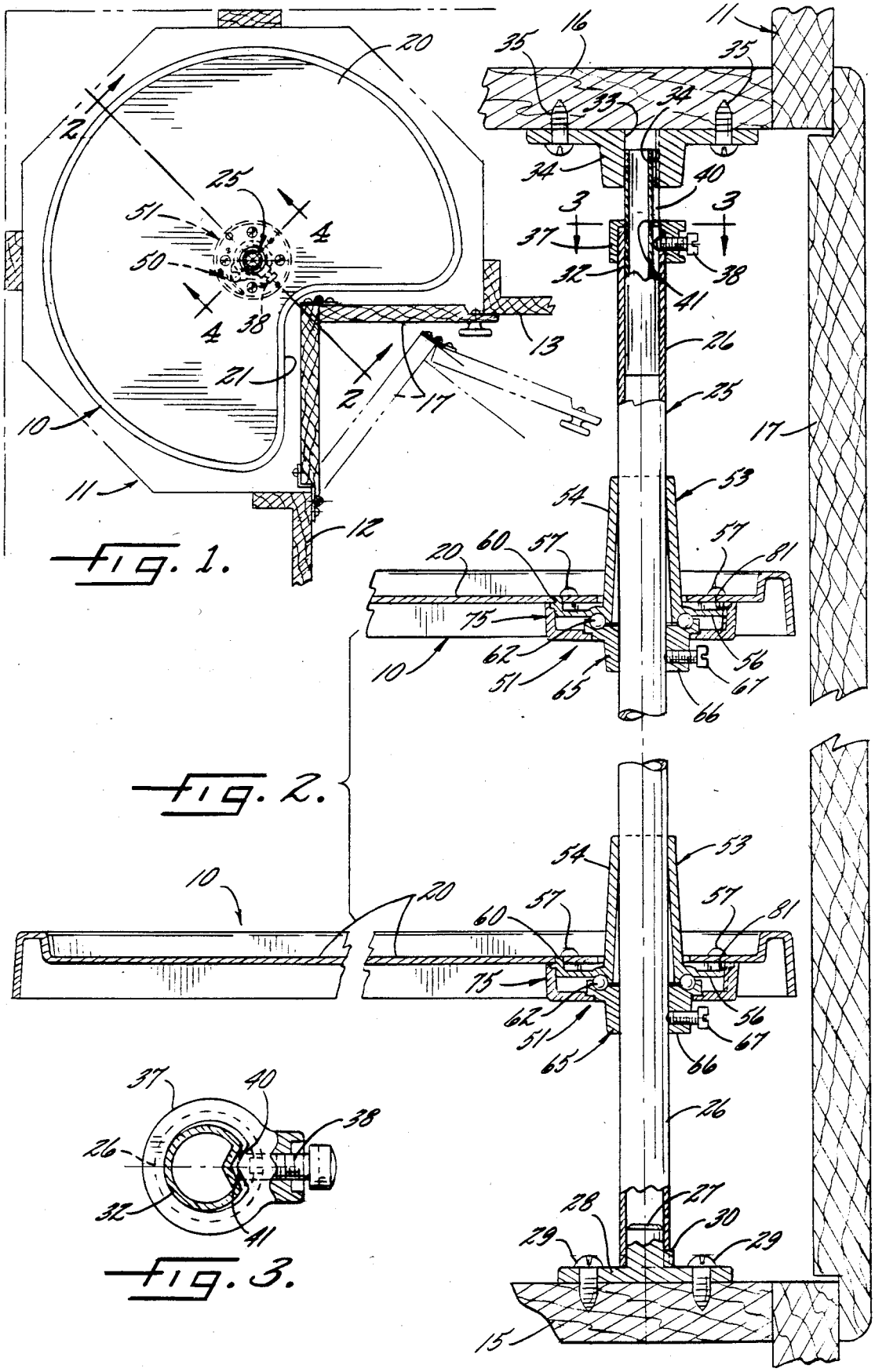
FIG. 1 is a fragmentary cross-sectional view taken horizontally through a typical cabinet equipped with a new and improved rotatable shelf assembly incorporating the unique features of the present invention.
FIG. 2 is an enlarged fragmentary cross-section taken substantially along the line 2—2 of FIG. 1.
FIG. 3 is an enlarged cross-section taken substantially along the line 3—3 of FIG. 2.

For purposes of illustration, the shelf assembly 10 of the present invention is shown in the drawings in conjunction with a corner cabinet 11 which may be located in the corner of a room at the ends of cabinets 12 and 13 extending along two right-angled walls of the room. The corner cabinet 11 includes a bottom wall 15 (FIG. 2), a top wall 16 and a bi-fold door 17 which may be swung to an open position as indicated in phantom lines in FIG. 1. When the door is closed as shown in full lines, its two panels extend at right angles to one another and form an aesthetically pleasing corner between the cabinets 12 and 13.

The present shelf assembly 10 includes two vertically spaced and generally circular shelves 20 which herein are made of plastic. The shelves are adapted to be rotated within the cabinet 11 and, in order to accommodate the bi-fold door 17 when the door is closed, each shelf is formed with a generally pie-shaped cut out 21 (FIG. 1) whose right-angled edges extend closely alongside the panels of the closed door.

Preferably, the two shelves 20 are mounted on a fixed post assembly 25 which enables the shelves to be rotated independently and which enables the shelf assembly 10 to be installed easily in the cabinet 11. Herein, the post assembly 25 includes a cylindrical lower post 26 (FIG. 2) in the form of a tube whose lower end is telescoped onto an upwardly projecting stud 27 formed integrally with a bracket 28 which is attached to the bottom wall 15 of the cabinet 11 by screws 29. A key 30 on the front side of the stud fits into a keyway in the lower end of the post 26 to fix the post against rotation and to orient the post in a proper angular position in the cabinet. The post 26 extends upwardly a substantial distance within the cabinet and supports both shelves 20.

The post assembly 25 further includes an upper post 32 (FIG. 2) which is adapted to be telescoped into the upper end portion of the lower post 26 and adjusted vertically relative thereto to enable the post assembly to be installed in cabinets of different heights. The upper end portion of the upper post 32 is telescoped into a hole 33 in an upper mounting bracket 34 which is attached to the top wall 16 of the cabinet 11 by screws 35.

An end cap 37 (FIGS. 2 and 3) is attached to the upper end of the lower post 26 by a set screw 38 and holds the upper post 32 in a fixed vertical position when the screw is tightened and seats in a V-shaped channel 40 (FIG. 3) formed by swaging one side of the upper post along its entire length. The end cap 37 is formed with a V-shaped key 41 which fits into the channel 40 to prevent the upper post from rotating relative to the lower post while permitting vertical adjustment of the upper post. Rotation of the upper post also is prevented by a key 43 formed on the upper bracket 34 and fitting into the channel 40.

After the brackets 28 and 34 have been installed, the lower post 26 is inserted downwardly through the shelves 20 and is telescoped onto the stud 27 of the lower bracket in keyed relation with the stud. The upper post 32 then is slid upwardly into the hole 33, after which the set screw 38 is tightened to lock the upper post to the lower post. Thus, installation of the post assembly 25 in cabinets of different heights can be achieved in a relatively quick and simple manner.

Because each shelf 20 is formed with the pie-shaped cut out 21, it is necessary to be able to locate the shelf in a predetermined angular home position in the cabinet 11 with the cut out facing outwardly as shown in FIG. 1 so as to allow full closure of the door 17. Moreover, it is highly desirable that the shelf be held releasably in its normal home position and that the shelf tends to automatically assume its home position following turning of the shelf so as to facilitate alinement of the cut out 21 with the front of the cabinet.

Because each shelf 20 is formed with the pie-shaped cut out 21, it is necessary to be able to locate the shelf in a predetermined angular home position in the cabinet 11 with the cut out facing outwardly as shown in FIG. 1 so as to allow full closure of the door 17. Moreover, it is highly desirable that the shelf be held releasably in its normal home position and that the shelf tend to automatically assume its home position following turning of the shelf so as to facilitate alinement of the cut out 21 with the front of the cabinet.

In accordance with the present invention, a detent mechanism 50 (FIGS. 4 and 5) for releasably holding each shelf 20 in its home position is uniquely incorporated into a novel bearing assembly 51 for mounting the shelf for rotation about the fixed post 26. As a result of incorporating the detent mechanism 50 into the bearing assembly 51, the combined unit is comparatively compact and may be attached to the shelf and the post in a relatively quick and easy manner.

More specifically, each bearing assembly 51 comprises a rotatable bearing member 53 (FIG. 4) which herein forms the upper part of the bearing assembly. The rotatable upper bearing member 53 preferably is made of plastic such as Delrin and includes an upwardly projecting tubular hub 54 which is telescoped over the post 26 and which rotates on the post. The inner surface of the hub tapers as the hub progresses upwardly, and only the extreme upper end portion of the hub lightly contacts the post so as to captivate the hub radially on the post. The inner surface of the hub is spaced radially from the post along most of the length of the hub and thus there is very little frictional contact between the hub and post.

Figure 4:
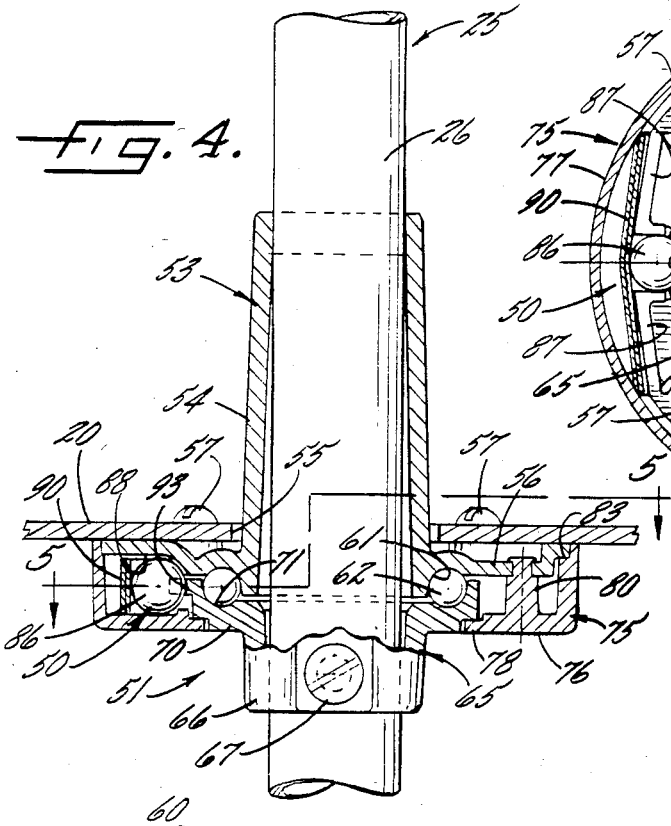
FIG. 4 is an enlarged fragmentary cross-section taken substantially along the line 4—4 of FIG. 1.
Figure 5:
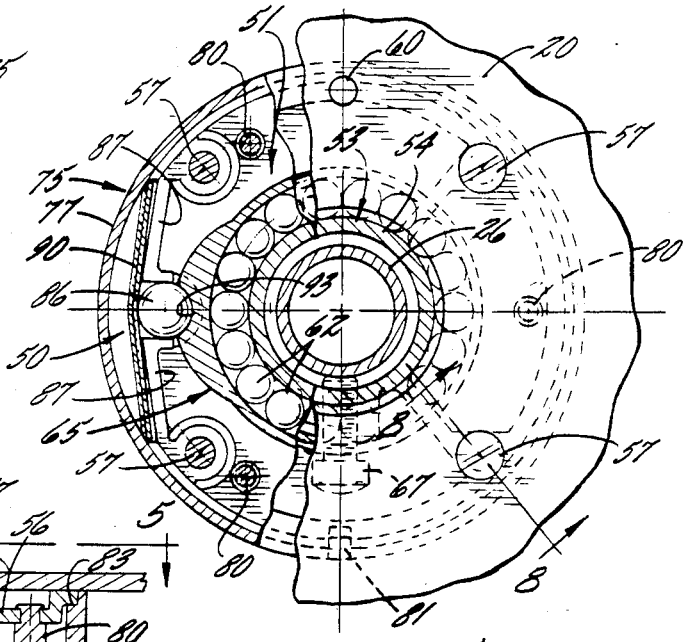
FIG. 5 is a fragmentary cross-section taken substantially along the line 5—5 of FIG. 4 and shows the detent mechanism holding the shelf in its predetermined angular position.
Figure 8:
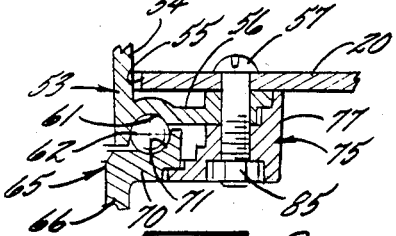
FIG. 8 is a fragmentary cross-section taken substantially along the line 8—8 of FIG. 5.

As shown most clearly in FIG. 4, the lower end portion of the hub 54 projects downwardly through a circular hole 55 in the shelf 20 and is formed integrally with a radially extending flange 56 which underlies the shelf. Four angularly spaced bolts 57 (FIGS. 4, 5 and 8) project downwardly through the shelf 20 and the flange 56 to secure the two together. A pin 60 (FIG. 5) is formed integrally with the flange 56 adjacent the outer periphery thereof and projects upwardly through a hole in the shelf to insure that the rotatable bearing member 53 is installed on the shelf in a correct angular orientation.

The lower side of the inner periphery of the flange 56 is formed with an annular groove 61 (FIG. 4) which defines a race for a circular row of bearing balls 62 adapted to roll on an underlying fixed bearing member 65 which forms part of the bearing assembly 51. In the present instance, the fixed bearing member 65 is a zinc die casting and is formed with a tubular hub 66 which fits snugly around the post 26. A set screw 67 is threaded through the hub 66 and engages the post 26 to anchor the fixed bearing member 65 tightly to the post in a fixed vertical and angular position. A radially extending flange 70 (FIG. 4) on the upper side of the hub 66 is formed with an annular groove 71 which defines a lower race for the bearing balls 62. As a result of the balls being located between the two bearing members 53 and 65, the shelf 20 is supported for relatively friction-free rotation and may be turned about the post 26 with very little effort.

In carrying out the invention, the detent mechanism 50 forms part of the bearing assembly 51 and includes an outer housing or cage 75 which holds the upper and lower bearing members 53 and 65 together as a unit both prior to and after attachment of the bearing members to the shelf 20 and the post 26. The cage is made of plastic, is of a generally cup-shaped configuration and includes a substantially flat bottom wall 76 (FIG. 4) and an annular side wall 77 which projects upwardly from the outer periphery of the bottom wall. The inner periphery of the bottom wall is formed with an inwardly projecting flange 78 which underlies the flange 70 of the lower bearing member 65 to captivate the lower bearing member against downward movement relative to the cage 75. Three angularly spaced pins 80 (FIGS. 4 and 5) are formed integrally with the bottom wall 76, project upwardly through holes in the flange 56 of the upper bearing member 53 and are heat staked at their upper ends to connect the cage 75 securely to the upper bearing member. A key 81 (FIG. 5) projecting radially inwardly from the upper end portion of the side wall 77 of the cage 75 fits into a keyway formed in the outer periphery of the flange 56 of the upper bearing member 53 and establishes proper angular orientation between the cage and the upper bearing member during assembly of the two. The outer periphery of the flange 56 seats within an annular groove 83 (FIG. 4) formed around the upper end of the side wall 77 of the cage 75 and thus the cage coacts with the upper and lower bearing members 53 and 65 to completely enclose the bearing balls 62 and to protect the balls from dirt and the like.

Accordingly, the cage 75 holds the upper and lower bearing members 53 and 65 in properly assembled relation prior to the time the upper bearing member is attached to the shelf by the bolts 57. When the bolts are installed, they also serve to secure the upper bearing member 53 tightly to the cage 75 in order to substantially strengthen and reinforce the connection effected by the heat-staked pins 80. Thus, and as shown most clearly in FIG. 8, the bolts 57 also extend through holes in the cage 75 and are fastened at their lower ends by nuts 85 which clamp against the bottom of the cage.

To hold the shelf 20 releasably in its home position, the detent assembly 50 includes a detent ball 86 which is carried by the cage 75. As shown in FIGS. 4 to 7, the detent ball is supported to roll radially inwardly and outwardly on the bottom wall 76 of the cage within a guideway defined between the ends of two ribs 87 formed integrally with and projecting upwardly from the bottom wall and extending generally chordwise of the cage. A radially extending pocket 88 (FIG. 4) formed in the lower side of the flange 56 also receives the ball 86. Two leaf springs 90 are trapped between the ribs 87 and the side wall 77 of the cage 75 and bear against the ball 86 to urge the latter inwardly.

The outer periphery of the flange 70 of the fixed lower bearing 65 includes various surfaces, some of which coact with the detent ball 86 depending upon the angular position of the shelf 20. Thus, the outer periphery of the flange 70 is formed with a circular surface 92 (FIG. 7) of substantial arcuate length, by an outwardly opening detent notch 93 of substantially shorter arcuate length and by two circumferentially extending cam surfaces 94 on opposite sides of the detent notch. Each cam surface 94 merges with the circular surface 92 and progresses radially outwardly as the cam surface progresses circumferentially from the circular surface to the detent notch 93. The extreme bottom of the detent notch 93 is spaced radially outwardly a short distance from the circular surface 92.

Figure 6:
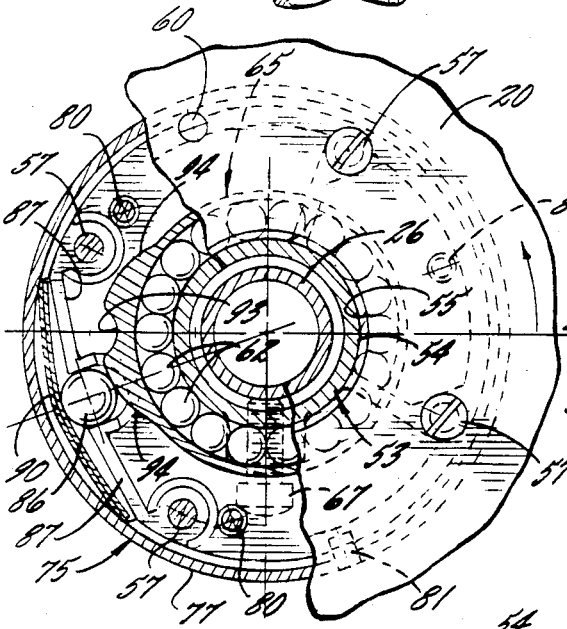
FIGS. 6 and 7 are views similar to FIG. 5 but show the location of the detent mechanism when the shelf is rotated to successively moved positions.
Figure 7:
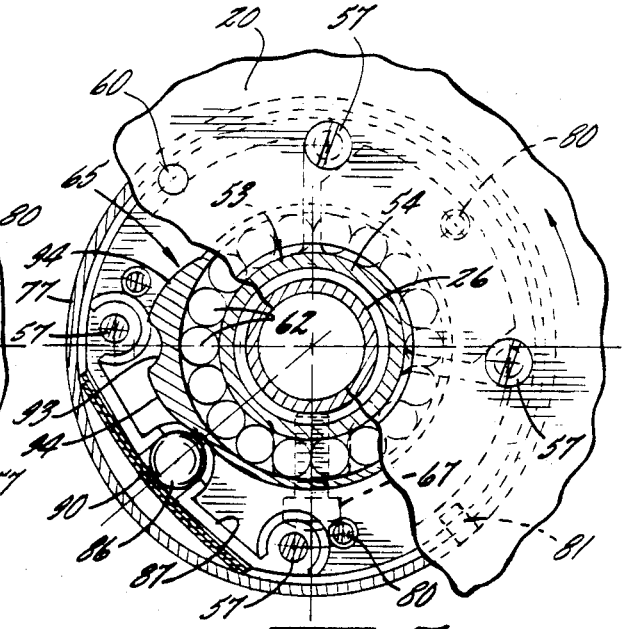

With the foregoing arrangement, the springs 90 urge the detent ball 86 into the detent notch 93 so that the ball releasably holds the shelf 20 against rotation when the shelf is located in its home position with the pie-shaped cut out 21 facing outwardly as shown in FIG. 1. If the shelf is rotated in either direction from the home position shown in FIG. 1, the ball 86 is cammed out of the notch 93 against the force of the springs 90. Being carried by the rotatable cage 75, the ball momentarily rides along one of the cam surfaces 94 as shown in FIG. 6. The springs bottom out against the ribs 87 with continued turning of the shelf when the ball leaves the cam surface 94 and thus the ball does not engage or only lightly engages the circular surface 92 so as to avoid interfering with free rotation of the shelf. Preferably, there is a small amount of clearance between the ball and the circular surface 92 (see FIG. 7).

When the shelf 20 is returned in either direction toward the detent position, the ball 86, upon leaving the area of the circular surface 92, encounters one of the cam surfaces 94 and is cammed outwardly to stress the springs 90 beyond the preload applied by the springs to the ball when the latter is in the notch 93 (see FIG. 6). As a result of the increased force applied to the ball, the ball exerts a retarding or braking force to the shelf 20 so as to slow down the shelf and assist in the ball re-seating in the notch 93 rather than skipping past the notch. In addition, the cam surfaces 94 impart "feel" to the action so that the person turning the shelf can detect when the shelf is approaching the detent position and can reduce the manual turning force to avoid overrunning the detent position.

As a result of the key 81, the upper bearing member 53 and the cage 75 are oriented in proper angular relationship with one another when these elements are assembled together by heat-staking the pins 80. By virtue of the pin 80, the entire bearing assembly 51 is oriented in proper angular relationship relative to the cut out 21 in the shelf 20 when the bearing assembly is attached to the shelf by the bolts 57. When the shelf then is installed on the post 26, it is necessary only to turn the shelf to a position such that the screw 67 of the lower bearing member 65 faces directly outwardly at a 45 degree angle as shown in FIG. 1. When the screw 67 is so positioned and is then tightened, the shelf becomes oriented such that, when the ball 86 stops the shelf in the detent position, the cut out 21 is properly located relative to the door 17. Accordingly, assembly of the bearing assembly 51, attachment of the bearing assembly to the shelf 20, and installation of the shelf on the post 26 is virtually foolproof.

From the foregoing, it will be apparent that the present invention brings to the art a new and improved rotary shelf assembly 10 having a fixed post 26 and having a combined bearing assembly/detent mechanism which is simple and compact in construction and which is quick and easy to install. The same bearing assembly 51 also can be easily converted for use with a truly circular shelf which does not require a detent or home position. To convert the assembly, it is only necessary to remove the ball 86 from the cage 75.

I claim:

1. A shelf assembly comprising a fixed upright mounting post, a generally horizontal shelf, and means for mounting said shelf for rotation about said post while enabling said shelf to be retained selectively in a predetermined angular position relative to the post, said means comprising a rotatable annular bearing member secured rigidly to said shelf, a fixed annular bearing member spaced vertically from said rotatable bearing member and secured rigidly to said post, antifriction means located between said bearing members and supporting said rotatable bearing member and said shelf for substantially free rotation relative to said fixed bearing member and said post, said fixed bearing member including an outer peripheral surface having a detent notch therein, an annular cage fixed to and rotatable with said rotatable bearing member and encircling said fixed bearing member in outwardly spaced relation with the outer peripheral surface of the fixed bearing member, a detent rotatable with said cage and supported by the cage to move radially inwardly and outwardly, spring means acting between said detent and said cage and urging said detent radially inwardly while resisting radial outward movement of said detent, said detent seating in said detent notch to retain said shelf releasably in said predetermined angular position and being cammed out of said detent notch when said shelf is rotated with sufficient force to overcome the force of said spring means.

2. A shelf assembly as defined in claim 1 in which the outer periphery of said fixed bearing member includes two circumferentially extending cam surfaces located at opposite sides of said detent notch, each of said cam surfaces progressing radially outwardly as the cam surface progresses circumferentially toward the notch.

3. A shelf assembly as defined in claim 1 in which said rotatable bearing member is an upper bearing member and includes a tubular hub projecting upwardly through said shelf, said rotatable bearing member including a radially extending flange underlying said shelf, and fasteners securing said flange to said shelf.

4. A shelf assembly as defined in claim 3 in which said fixed bearing member is a lower bearing member and includes a flange underlying the flange of said rotatable bearing member, said anti-friction means comprising a circular row of ball bearings located between said flanges.

5. A shelf assembly as defined in claim 4 in which said cage comprises a cup-shaped member having a bottom wall underlying said fixed bearing member, and means on said cage connecting said bearing members and said cage together as a unit.

6. A shelf assembly as defined in claim 5 further including means independent of said connecting means for establishing a predetermined angular relationship between said rotatable bearing member and said cage.

7. A shelf assembly as defined in claim 6 in which said fasteners also secure said rotatable bearing member to said cage, said fasteners securing said rotatable bearing member to said cage independently of said connecting means.

8. A shelf assembly as defined in claim 7 further including means independent of said fasteners for establishing a predetermined angular relationship between said rotatable bearing member and said shelf.

9. A shelf assembly comprising a fixed upright mounting post, a generally horizontal shelf, and means for mounting said shelf for rotation about said post while enabling said shelf to be retained selectively in a predetermined angular position relative to the post, said means comprising a rotatable annular bearing member secured rigidly to said shelf, a fixed annular bearing member spaced vertically from said rotatable bearing member and secured rigidly to said post, bearing balls located between said bearing members and supporting said rotatable bearing member and said shelf for substantially free rotation relative to said fixed bearing member and said post, said fixed bearing member having an outer periphery defined by a circular surface of substantial arcuate length, by an outwardly opening detent notch of substantially shorter arcuate length and by two circumferentially extending cam surfaces located at opposite sides of the detent notch, each of said cam surfaces merging with said circular surface and progressing radially outwardly as the cam surface progresses circumferentially from the circular surface toward the detent notch, an annular cage fixed to and rotatable with said rotatable bearing member and rotatably encircling said fixed bearing member in outwardly spaced relation with the outer periphery of the fixed bearing member, a detent ball 86 rotatable with said cage and supported by the cage to move radially inwardly and outwardly, spring means 90 acting between said cage and said detent ball and urging said detent ball radially inwardly while resisting radial outward movement of the detent ball, said detent ball riding substantially clear of said circular surface during free rotation of said shelf, said detent ball engaging one of said cam surfaces as said shelf approaches said predetermined angular position and applying a retarding force to the shelf, and said detent ball seating in said detent notch as said shelf reaches said predetermined angular position and serving to releasably hold the shelf in such position.

* * * * *